US007828588B2

(12) United States Patent
Lin et al.

(10) Patent No.: US 7,828,588 B2
(45) Date of Patent: Nov. 9, 2010

(54) CONNECTOR STRUCTURE WITH TWO ASSEMBLING DIRECTIONS

(75) Inventors: Po-Chih Lin, Taipei (TW); Shu-Fang Chueh, Taipei (TW)

(73) Assignee: Pegatron Corporation, Taipei (TW)

( * ) Notice: Subject to any disclaimer, the term of this patent is extended or adjusted under 35 U.S.C. 154(b) by 0 days.

(21) Appl. No.: 12/536,155

(22) Filed: Aug. 5, 2009

(65) Prior Publication Data

US 2010/0035462 A1 Feb. 11, 2010

(30) Foreign Application Priority Data

Aug. 6, 2008 (TW) ..... 97129799 A

(51) Int. Cl.
*H01R 12/24* (2006.01)

(52) U.S. Cl. ..... 439/495; 439/67

(58) Field of Classification Search ..... 439/260, 439/67, 331, 135–136, 142, 492, 495, 259
See application file for complete search history.

(56) References Cited

U.S. PATENT DOCUMENTS 5,664,964 A 9/1997 Crofoot et al.
7,238,032 B2 * 7/2007 Pabst et al. ..... 439/67
7,341,470 B2 * 3/2008 Suzuki et al. ..... 439/260
7,407,409 B2 * 8/2008 Lee ..... 439/495
7,527,511 B1 * 5/2009 Peng et al. ..... 439/260
7,581,983 B1 * 9/2009 Yuan et al. ..... 439/495
2006/0089028 A1 * 4/2006 Higham et al. ..... 439/136

FOREIGN PATENT DOCUMENTS

DE 010065972 A1 * 12/2000
TW 1547289 A 11/2004

* cited by examiner

*Primary Examiner*—Michael C Zarroli
(74) *Attorney, Agent, or Firm*—Tim Tingkang Xia; Morris, Manning & Martin, LLP

(57) ABSTRACT

This invention discloses a connector structure including a base, a plurality of metal pins, and a cover. The metal pins are disposed at the base. The cover has a first side and a second side being separately and pivotally connected to the base, respectively. The first side is capable of being operated to be separated from the base and to rotate around the second side for exposing one part of the metal pins. The second side is capable of being operated to be separated from the base and to rotate around the first side for exposing one part of the metal pins.

9 Claims, 8 Drawing Sheets

CONNECTOR STRUCTURE WITH TWO ASSEMBLING DIRECTIONS

CROSS-REFERENCE TO RELATED APPLICATIONS

This Non-provisional application claims priority under 35 U.S.C. §119(a) on Patent Application No(s). 097129799 filed in Taiwan, Republic of China on Aug. 6, 2008, the entire contents of which are hereby incorporated by reference.

BACKGROUND OF THE INVENTION

1. Field of the Invention

The invention relates to a connector structure and, more particularly, to a connector structure capable of assembling a flat flexible cable (FFC) or a flexible printed circuit (FPC) from two directions.

2. Description of the Related Art

A flat flexible cable (FFC) or a flexible printed circuit (FPC) is widely applied to different electronic components on a present printed circuit board (PCB) for transmitting signals between the electronic components. For example, the flat flexible cable or the flexible printed circuit may be used between a display device and a processor of a mobile phone, between a controller and a printing nozzle of an ink-jet printer, and between different components on a circuit board. Therefore, the two connection wires are made of flexible materials, thereby increasing a plurality of elasticity for packaging manufacture of a circuit. Different from fixed direct solder having lower cost or pluggable crimped contact having a complex structure, the flat flexible cable and the flexible printed circuit are pluggable, and also have simple structures, small volume, and low cost. The flat flexible cable and the flexible printed circuit are suitable for signal transmission of a printed circuit board.

On a printed circuit board, a connector capable of receiving and fastening a flat flexible cable or a flexible printed circuit is needed. Please refer to FIG. 1. FIG 1 is a schematic diagram showing an appearance of a connector structure according to the prior art. In FIG. 1, a connector 1 includes a base 10, a plurality of metal pins 12, and a cover 14. The base 10 includes a pair of pivotal bases 101 located at two sides of the base 10, respectively. The metal pins 12 are disposed at the base 10 and are located between the two pivotal bases 101. One terminal of the metal pin 12 is electrically connected to the flat flexible cable or the flexible printed circuit (not shown), and the other terminal is electrically connected to other components (not shown) on the printed circuit board. The cover 14 has a first side 141 and a second side 142. Two ends of the second cover 142 are pivotally connected to the two pivotal bases 101 of the base 10, respectively. A user can lift or press the first side 141 to rotate the cover 14 upward and downward relative to the base 10.

When a user is to connect the flat flexible cable or the flexible printed circuit to the connector 1, he or she can lift the first side 141 to rotate the cover 14 upward to expose the metal pins 12 on the base 10. Then, the flat flexible cable or the flexible printed circuit (not shown) is slid in parallel to the top of the metal pins 12 between the two pivotal bases 101 from the first side 141 of the connector 1. Next, the user can press the first side 141 to rotate the cover 14 downward to cover the pivotal bases 101 of the base 10. Thus, the flat flexible cable or the flexible printed circuit (not shown) is electrically connected with the metal pins 12 of the connector 1.

Since the connector 1 in the prior art is a unidirectional opening, only one side can be used for connection. Once the side cannot be used for connection due to a space design of the printed circuit board or wires need to be specially arranged, the other side has to be used for the connection. At that moment, the connector 1 needs to rotate 180 degrees, and metal wiring on the printed circuit board also needs to be modified according to the change of a direction of inserting the metal pins 12 of the connector 1. Since the circuit needs to be redesigned, additional cost is needed, and efficiency of the circuit research and design decreases.

BRIEF SUMMARY OF THE INVENTION

One objective of this invention is to provide a connector structure capable of assembling a flat flexible cable (FFC) or a flexible printed circuit (FPC) from two directions.

According to a embodiment of the invention, the connector structure provided includes a base and a cover. A plurality of metal pins are disposed at the base. The cover has a first side and a second side being separately and pivotally connected to the base for covering one part of the metal pins.

In the embodiment, the first side of the cover is capable of being operated to be separated from the base and to rotate around the second side. Thus, the part of the metal pins is exposed for assembling a flat flexible cable or a flexible printed circuit. The second side of the cover is capable of being operated to be separated from the base and to rotate around the first side. Thus, the part of the metal pins is exposed for assembling the flat flexible cable or the flexible printed circuit.

According to another embodiment of the invention, the connector structure provided includes a base, a first cover, and a second cover. A plurality of metal pins are disposed at the base. The first cover has a first side and a third side, and the second cover has a second side and a fourth side. The third side and the fourth side are pivotally connected to the base, respectively.

In the embodiment, the first side of the first cover is capable of being operated to rotate around the third side to expose the part of the metal pins for assembling a flat flexible cable or a flexible printed circuit. The second side of the second cover is capable of being operated to rotate around the fourth side to expose one part of the metal pins for assembling the flat flexible cable or the flexible printed circuit.

Therefore, in the embodiment of the invention, a connector structure is capable of assembling a flat flexible cable or a flexible printed circuit from two directions by a single cover capable of being opened from two directions or a group of the first cover and the second cover capable of being opened from opposite directions. According to the connector structure provided by the invention, when wires need to be specially arranged thus to have to change a direction of inserting the connection wire, the connector structure does not need to be rotated and the wiring on the circuit board does not need to be modified. It is easy to insert the connection wire from the other side for completing the electrical connection.

These and other features, aspects, and advantages of the present invention will become better understood with regard to the following description, appended claims, and accompanying drawings.

DETAILED DESCRIPTION OF THE INVENTION

Figure 1:
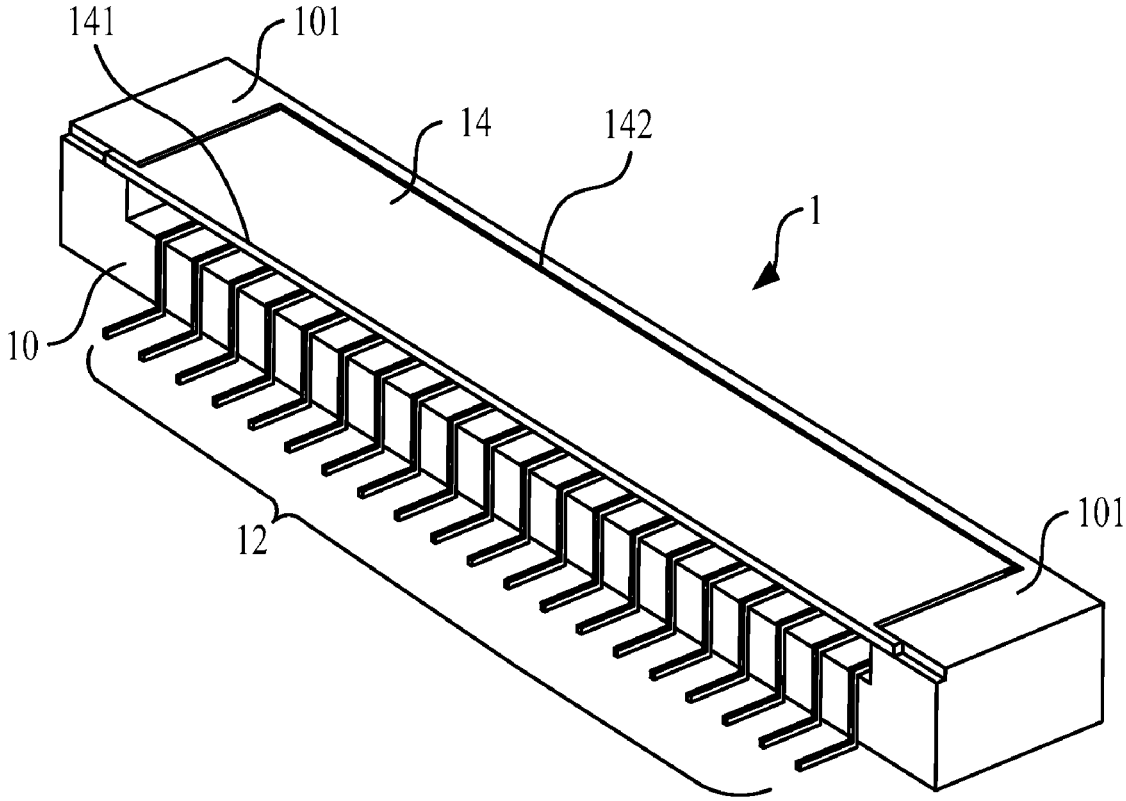
FIG. 1 (Prior Art)
FIG. 1 is a schematic diagram showing an appearance of a connector structure according to the prior art.
Figure 2:
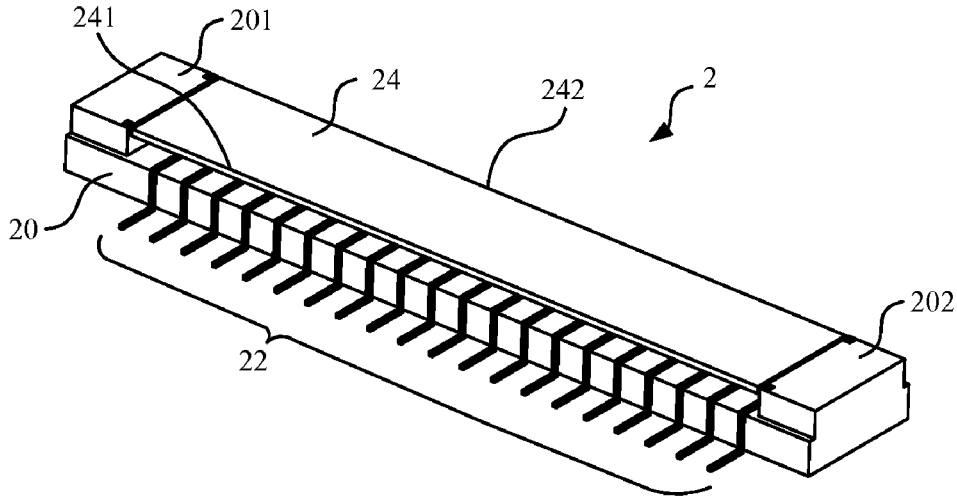
FIG. 2 is a schematic diagram showing an appearance of a connector structure according to a first embodiment of the invention.
Figure 3:
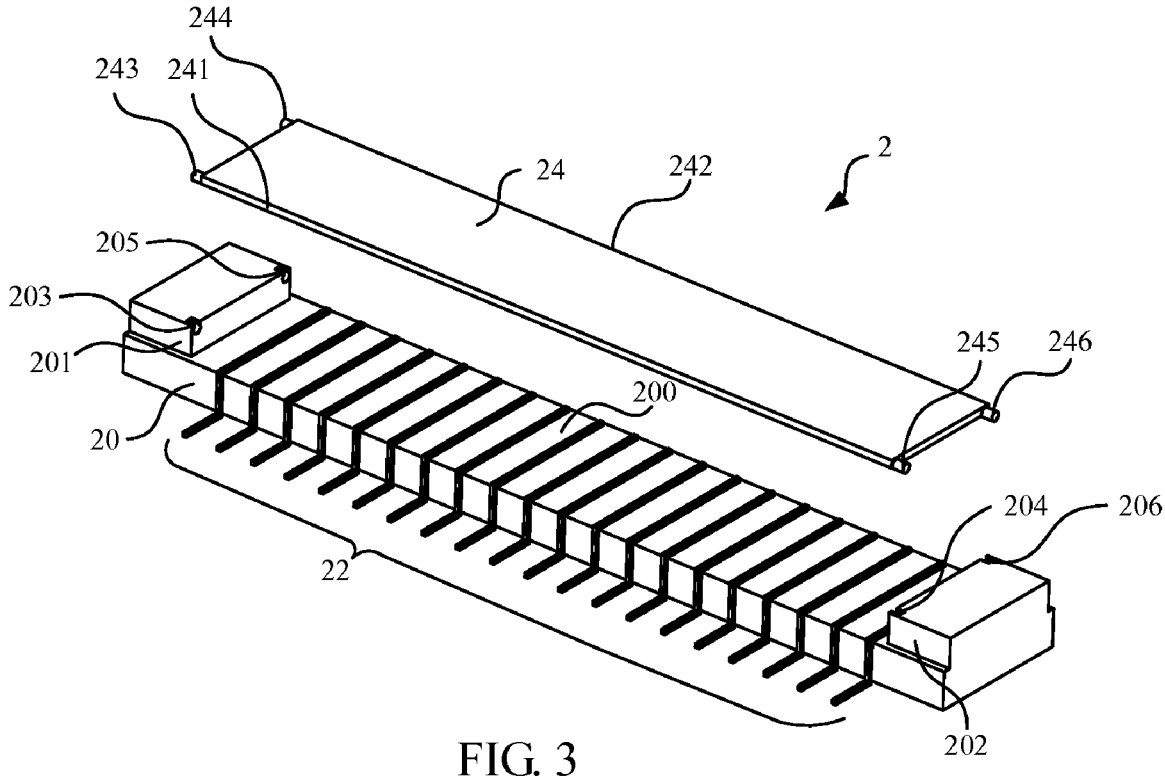
FIG. 3 is an exploded diagram showing the connector structure in FIG. 2.

FIG. 2 is a schematic diagram showing an appearance of a connector structure according to a first embodiment of the invention. FIG. 3 is an exploded diagram showing the connector structure in FIG. 2. Please refer to FIG. 2 and FIG. 3. In the first embodiment of the invention, a connector structure 2 includes a base 20, a plurality of metal pins 22, and a cover 24. The cover 24 is pivotally connected to the base 20. The cover 24 covers the metal pins 22 on the surface of the base 20 for fastening a flat flexible cable (FFC) or a flexible printed circuit (FPC) capable of electrically connecting the metal pins 22 and for enhancing stability of the electrical connection.

In the embodiment, the metal pins 22 may be made of copper, silver, or other conductive single or composite metal materials. The size of the base 20 and the cover 24 is adjusted in cooperation with the flat flexible cable or the flexible printed circuit.

In FIG. 2, the base 20 includes a first pivotal base 201 and a second pivotal base 202. The first pivotal base 201 and the second pivotal base 202 are located at two ends of the base 20, respectively, and they are formed by extending upward from the two ends of the base 20. As shown in FIG. 3, the base 20 has a saddle portion 200 between the first pivotal base 201 and the second pivotal base 202.

The metal pins 22 are disposed on the saddle portion 200 of the base 20 and are located between the first pivotal base 201 and the second pivotal base 202. The metal pins 22 are used for electrically connecting the flat flexible cable or the flexible printed circuit. In the embodiment, the metal pins 22 extend toward the outside of the base 20 to facilitate electrically connecting metal connection portions (not shown) on a circuit board (not shown). Thus, a passage for receiving or transmitting signals between the circuit board and flat flexible cable or the flexible printed circuit is formed.

In FIG. 3, the cover 24 has a first side 241 and a second side 242. Two ends of the first side 241 have a first hinge 243 and a second hinge 245, respectively. Two ends of the second side 242 have a third hinge 244 and a fourth hinge 246, respectively.

The first pivotal base 201 has a first groove 203 adjacent to the first side 241 for containing the first hinge 243. The first pivotal base 201 has a third groove 205 adjacent to the second side 242 for containing the third hinge 244. The second pivotal base 202 has a second groove 204 adjacent to the first side 241 for containing the second hinge 245. The second pivotal base 202 has a fourth groove 206 adjacent to the second side 242 for containing the fourth hinge 246.

Figure 4:
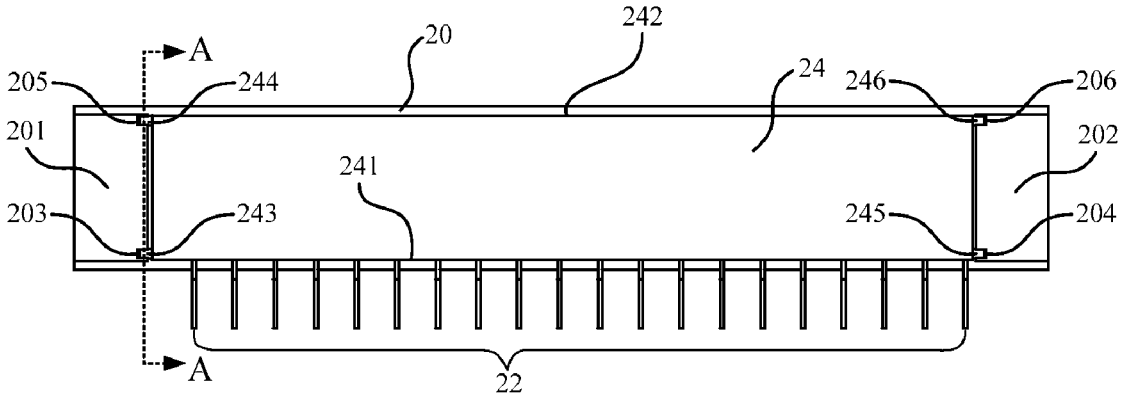
FIG. 4 is a top view showing the connector structure in FIG. 2.
Figure 5:
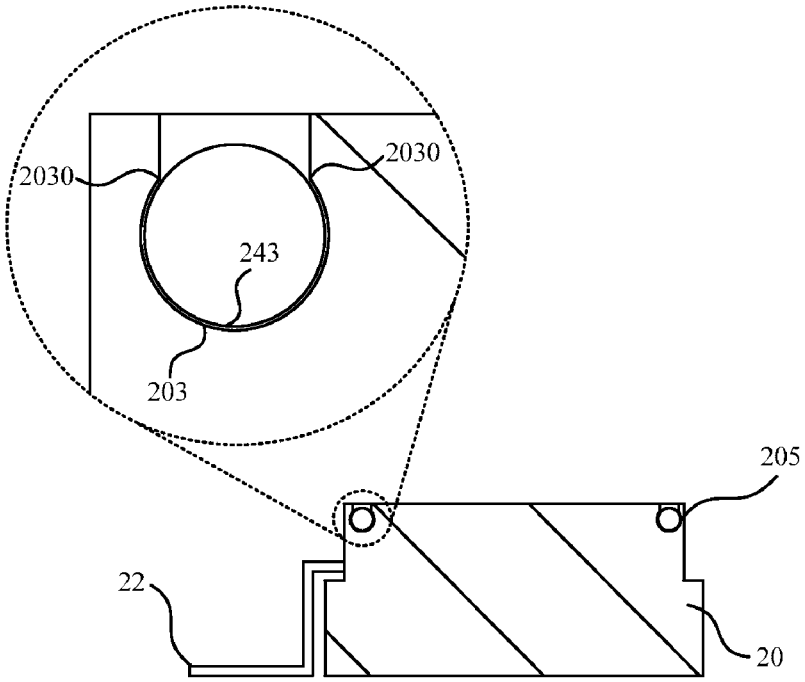
FIG. 5 is a sectional diagram showing the connector structure in FIG. 4 along a sectional line A-A.

FIG. 4 is a top view showing the connector structure 2 in FIG. 2. FIG. 5 is a sectional diagram showing the connector structure 2 in FIG. 4 along a sectional line A-A. Please refer to FIG. 4 and FIG. 5. The first side 241 of the cover 24 is separately and pivotally connected to the first groove 203 of the first pivotal base 201 and the second groove 204 of the second pivotal base 202 via the first hinge 243 and the second hinge 245, respectively. Further, the second side 242 of the cover 24 is separately and pivotally connected to the third groove 205 of the first pivotal base 201 and the fourth groove 206 of the second pivotal base 202 by the third hinge 244 and the fourth hinge 246, respectively.

In FIG. 5, the first groove 203 has a first fastening portion 2030. When the first hinge 243 is located in the first indentation groove 203, the first fastening portion 2030 is fastened to the first hinge 243, thus to limit the movement of the first hinge 243. The second groove 204, the third groove 205, and the fourth groove 206 also have fastening portions (not shown) capable of fastening the second hinge 245, the third hinge 244, and the fourth hinge 246, respectively. The structure feature is the same as the first fastening portion 2030. Therefore, they are not described for a concise purpose.

Figure 6:
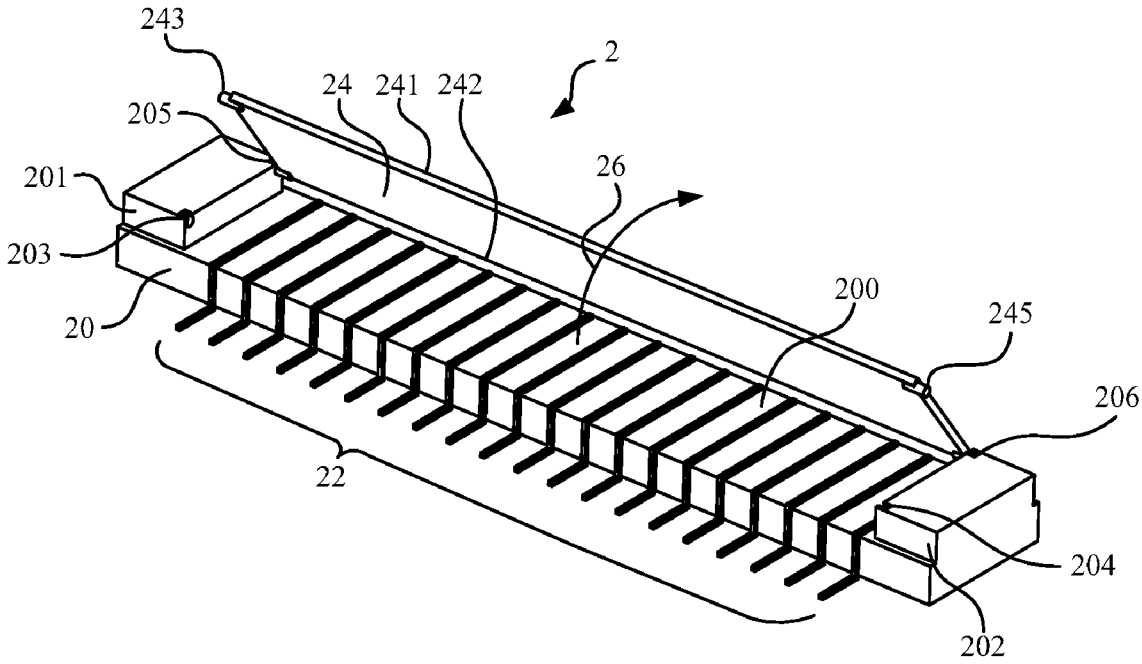
FIG. 6 is a schematic diagram showing an appearance of the connector structure in FIG. 2 when a first side of the connector structure is operated to be separated from a base.

FIG. 6 is a schematic diagram showing an appearance of the connector structure 2 in FIG. 2 when the first side 241 of the connector structure 2 is operated to be separated from the base 20. When a user is to insert a flat flexible cable or a flexible printed circuit from the first side 241 of the connector structure 2 to electrically connect the metal pins 22, the user lifts the first side 241 around the second side 242 to rotate the first side 241 toward a first direction 26 for separating the first side 241 from the base 20. In the embodiment, the first direction 26 is a clockwise direction, and one part of the metal pins 22 is exposed. The user assembles the flat flexible cable or the flexible printed circuit at the saddle portion 200 of the base 20 in parallel. Then, the user operates the first side 241 of the cover 24 toward an opposition direction. When the user rotates the cover 24 to be approximately parallel to the base 20, he or she presses the first side 241 to make the first hinge 243 of the first side 241 slide into the first groove 203 and to make the second hinge 245 of the first side 241 slide into the second groove 204 at the same time.

Figure 7:
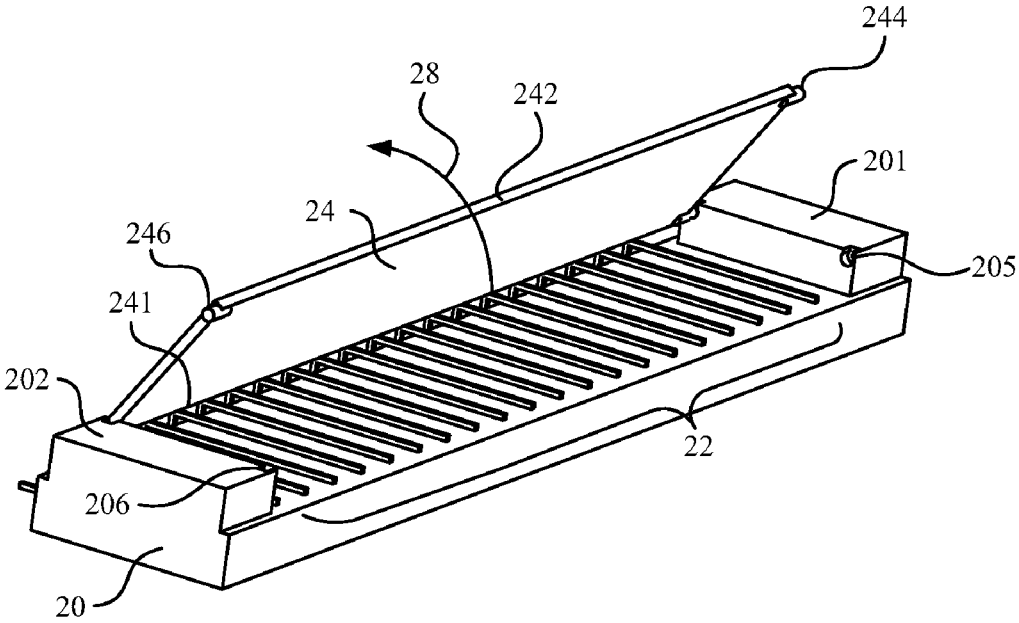
FIG. 7 is a schematic diagram showing an appearance of the connector structure in FIG. 2 when a second side of the connector structure is operated to be separated from a base.

In another aspect, the user can also insert the flat flexible cable or the flexible printed circuit from the second side 242 of the connector structure 2 to electrically connect the metal pins 22. Please refer to FIG. 7. FIG. 7 is a schematic diagram showing an appearance of the connector structure 2 in FIG. 2 when the second side 242 of the connector structure 2 is operated to be separated from the base 20. The user lifts the second side 242 around the first side 241 to rotate the second side 242 toward a second direction 28 for separating the second side 242 from the base 20. The second direction 28 is opposite to the first direction 26. In the embodiment, the second direction 28 is a counter-clockwise direction. By the rotation of the second side 242 of the cover 24, one part of the metal pins 22 is exposed. The user assembles the flat flexible cable or the flexible printed circuit on the base 20, and then he or she presses the second side 242 to make the second side 242 fastened to the base 20, thereby fastening the flat flexible cable or the flexible printed circuit.

Figure 8:
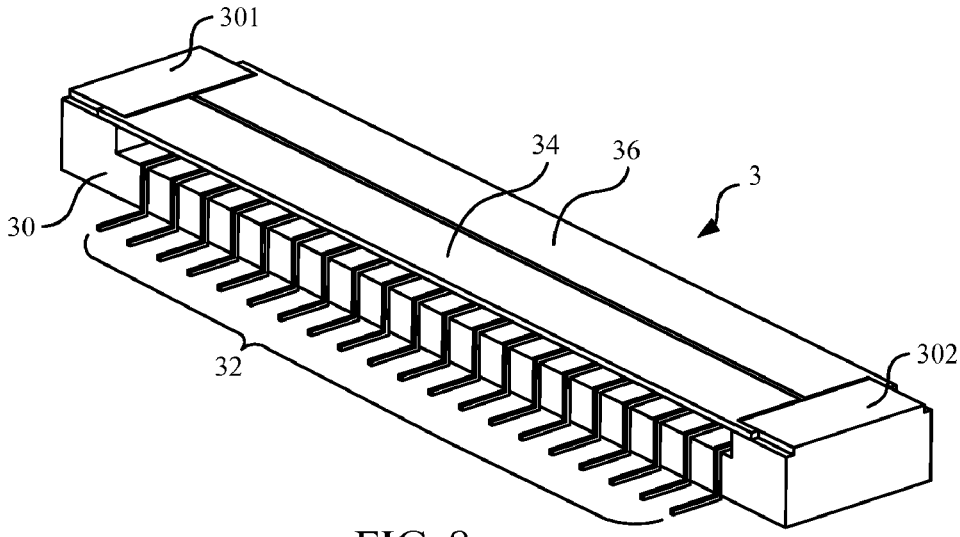
FIG. 8 is a schematic diagram showing an appearance of a connector structure according to a second embodiment of the invention.
Figure 9:
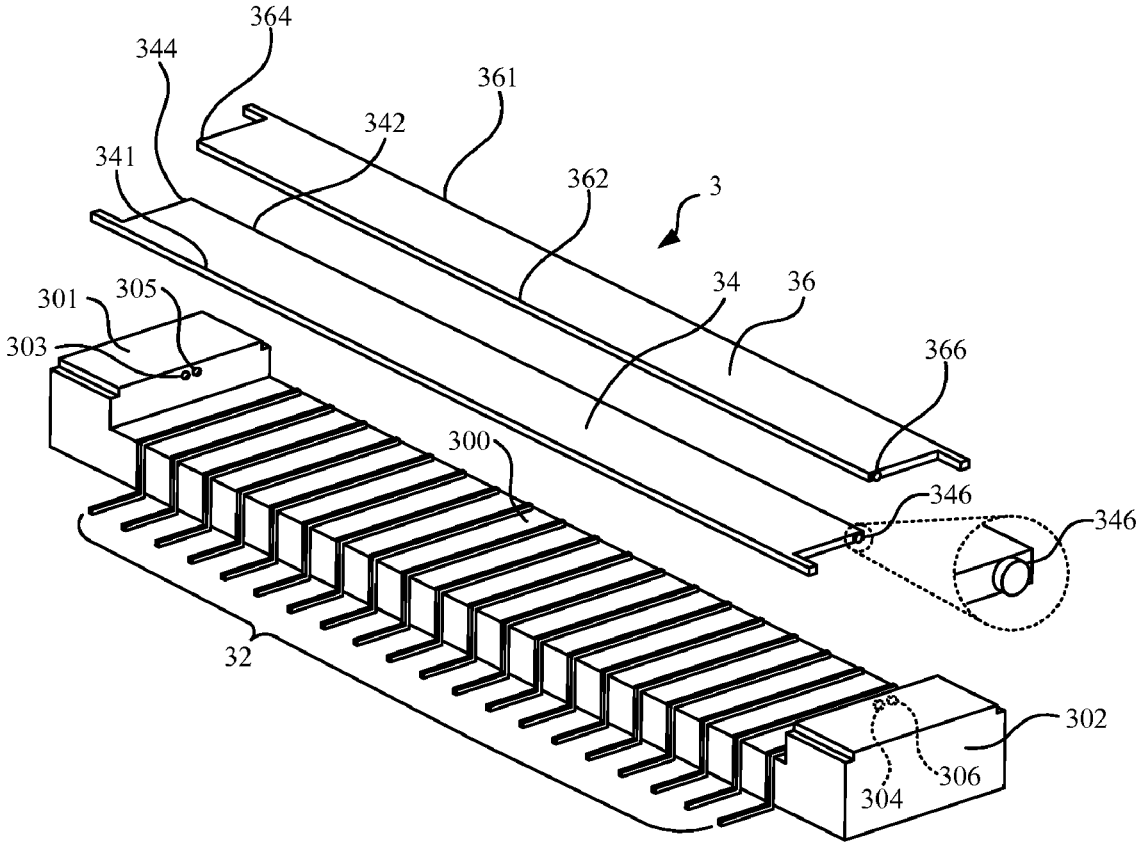
FIG. 9 is an exploded diagram showing the connector structure in FIG. 8.

FIG. 8 is a schematic diagram showing a connector structure 3 according to a second embodiment of the invention. FIG. 9 is an exploded diagram showing the connector structure 3 in FIG. 8. Please refer to FIG. 8 and FIG. 9. In the second embodiment of the invention, the connector structure 3 includes a base 30, a plurality of metal pins 32, a first cover 34, and a second cover 36. The first cover 34 and the second cover 36 are pivotally connected to the base 30, respectively. The first cover 34 and the second cover 36 cover the base 30, respectively, for fastening a flat flexible cable or a flexible printed circuit electrically connecting the metal pins 32.

In FIG. 8, the base 30 includes a first pivotal base 301 and a second pivotal base 302. The first pivotal base 301 and the second pivotal base are located at two ends of the base 30, respectively, and they extend upward from the two ends of the base 30. As shown in FIG. 9, the base 30 has a saddle portion 300 between the first pivotal base 301 and the second pivotal base 302.

In FIG. 9, the first cover 34 has a first side 341 and a third side 342. The third side 342 is pivotally connected between the first pivotal base 301 and the second pivotal base 302 of the base 30. Two ends of the third side 342 have a first hinge 344 and a second hinge 346, respectively. The first hinge 344 and the second hinge 346 are inserted into a first hole 303 of the first pivotal base 301 and a second hole 304 of the second pivotal base 302, respectively.

Figure 10:
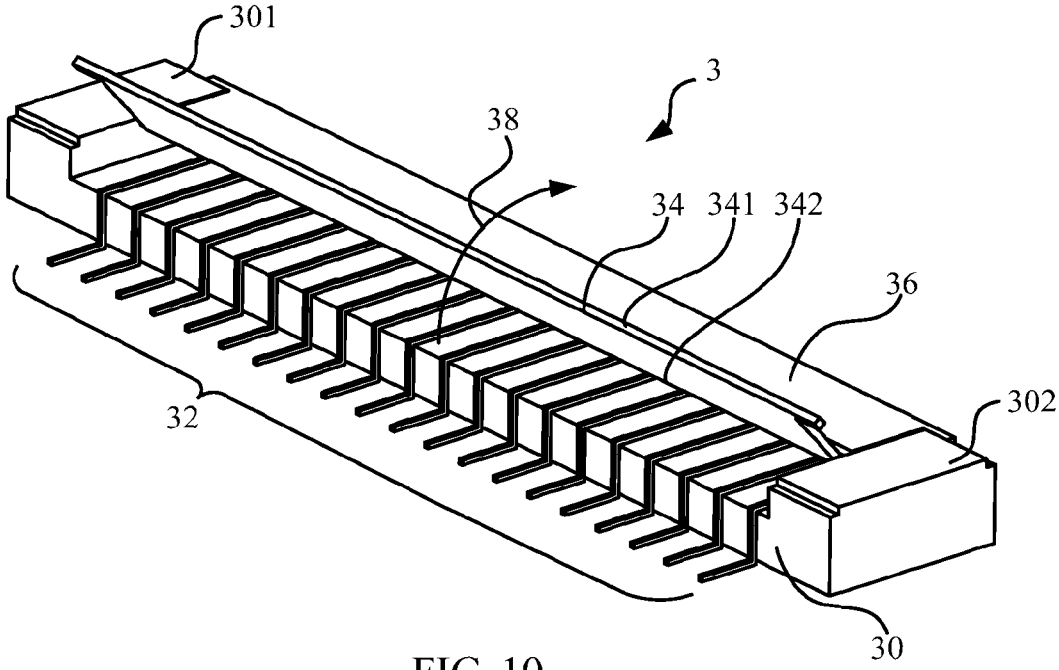
FIG. 10 is a schematic diagram showing an appearance of the connector structure in FIG. 8 when a first side of the connector structure is operated to be separated from a base

FIG. 10 is a schematic diagram showing an appearance of the connector structure 3 in FIG. 8 when the first side 341 of the connector structure 3 is operated to be separated from the base 30. Please refer to FIG. 10. When a user is to assemble the flat flexible cable or the flexible printed circuit from the first cover 34 of the connector structure 3, the user lifts the first side 341 of the first cover 34 to rotate the cover 34 around the third side 342 toward a first direction 38 for separating the first side 341 from the base 30. In the embodiment, the first direction 38 is a clockwise direction, and one part of the metal pins 32 is exposed. The user assembles the flat flexible cable or the flexible printed circuit on the saddle portion 300 of the base 30 in parallel to electrically connect the metal pins 32. Then, the user can operate the first side 341 of the first cover 34 toward an opposite direction to rotate the first cover 34 to cover the base 30 for completing the connection.

Please refer to FIG. 9. The second cover 36 of the connector structure 3 includes a second side 361 and a fourth side 362. The fourth side 362 is pivotally connected between the first pivotal base 301 and the second pivotal base 302. Two ends of the fourth side 362 have a third hinge 364 and a fourth hinge 366, respectively. The third hinge 364 and the fourth hinge 366 can be inserted into a third hole 305 of the first pivotal base 301 and a fourth hole 306 of the second pivotal base 302, respectively.

Figure 11:
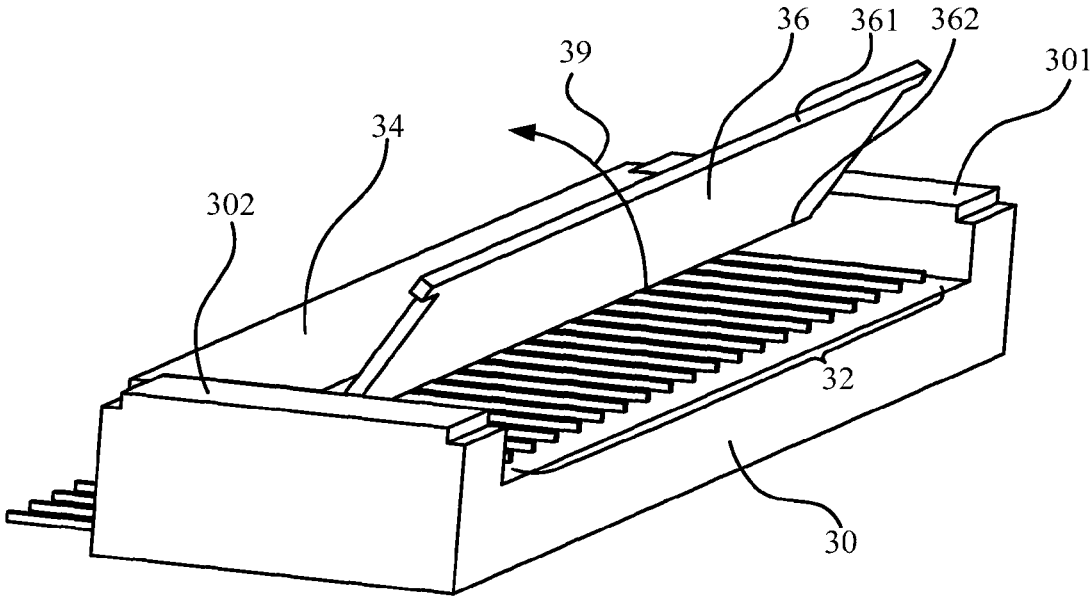
FIG. 11 is a schematic diagram showing an appearance of the connector structure in FIG. 8 when a second side of the connector structure is operated to be separated from a base.

FIG. 11 is a schematic diagram showing an appearance of the connector structure 3 in FIG. 8. The second side 361 of the connector structure 3 is operated to be separated from the base 30 in FIG. 11. When the user assembles the flat flexible cable or the flexible printed circuit from the second cover 36 of the connector structure 3, the user lifts the second side 361 of the second cover 36 to rotate the second cover 36 around the fourth side 362 toward a second direction 39 for separating the second side 361 from the base 30. The second direction 39 is opposite to the first direction 38. In the embodiment, the second direction 39 is a counter-clockwise direction, and one part of the metal pins 32 is exposed. The user assembles the flat flexible cable or the flexible printed circuit on the saddle portion 300 of the base 30 in parallel to electrically connect the metal pins 32. Then, the user operates the second side 361 of the second cover 36 toward an opposite direction to rotate the second cover 36 to cover the base 30 for completing the connection.

According to the above embodiments of the invention, a connector structure capable of assembling a flat flexible cable or a flexible printed circuit from two directions is formed by a single cover capable of being opened from two directions or a group of the first cover and the second cover capable of being opened from opposite directions.

Figure 12:
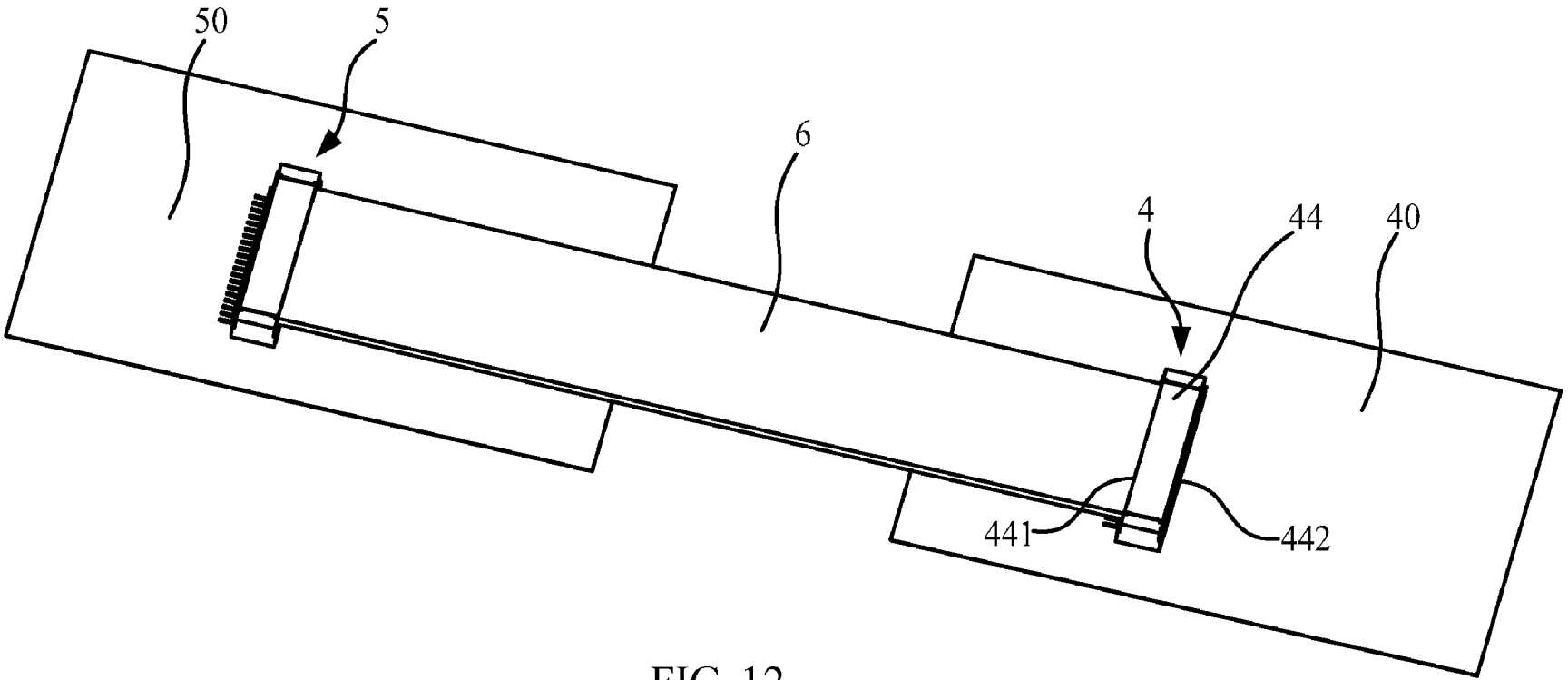
FIG. 12 is a schematic diagram showing two connector structures provided by the embodiments of the invention connecting a connection wire.
Figure 13:
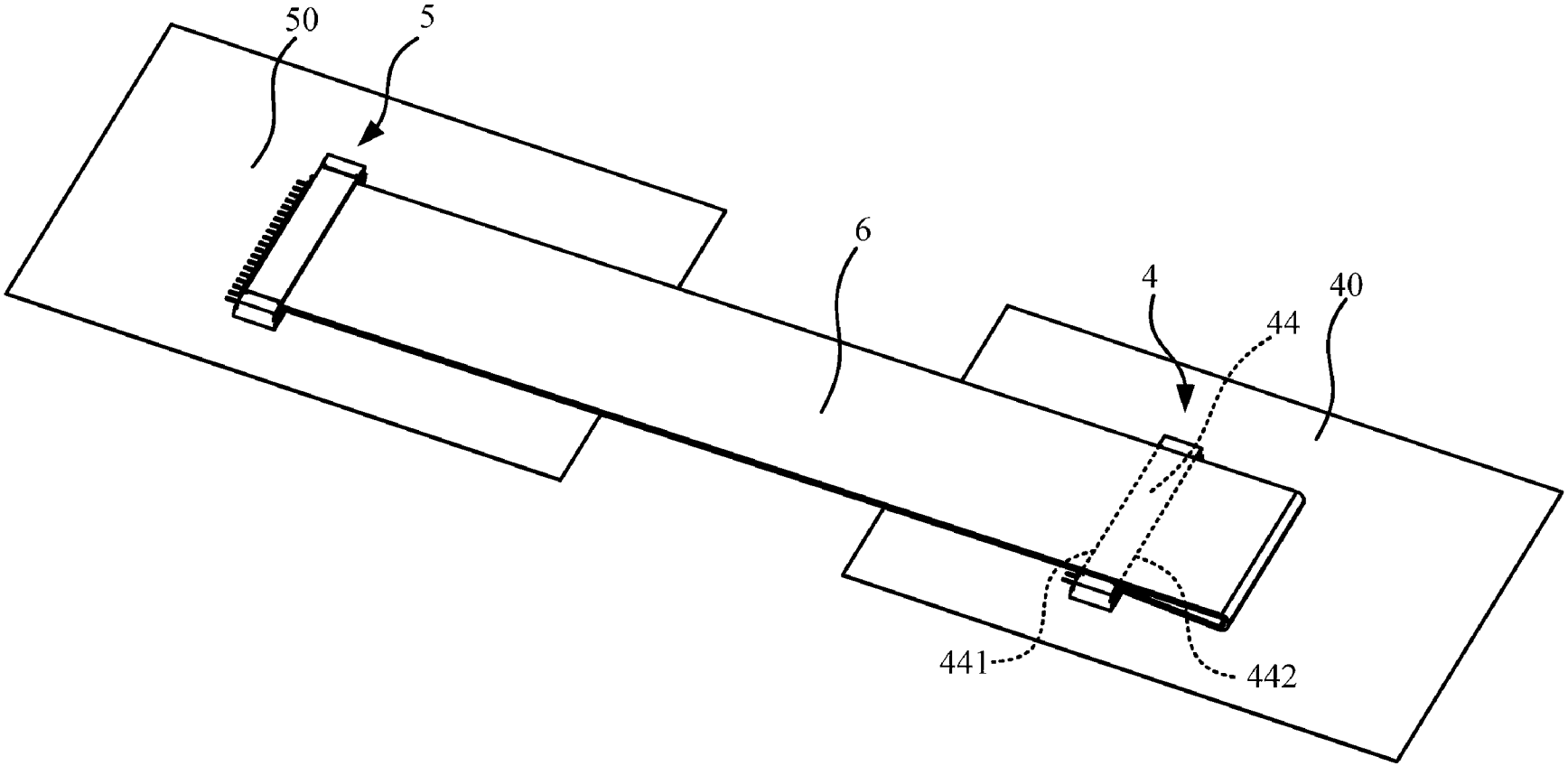
FIG. 13 is a schematic diagram showing two connector structures provided by the embodiments of the invention connecting a connection wire.

FIG. 12 and FIG. 13 are schematic diagrams showing connector structures 4, 5 in the above two embodiments connecting a connection wire 6. Please refer to FIG. 12 and FIG. 13. The connector structures 4, 5 are the same as the connector structure 2 in FIG. 2. The connector structure 4 and the connector structure 5 are located at circuit boards 40, 50, respectively. The connection wire 6 may be a flat flexible cable or a flexible printed circuit.

The circuit boards 40, 50 further have metal connection portions (not shown) matching the connector structures 4, 5 for connecting other electronic components (not shown). Signals between the electronic components can be transmitted via a passage formed by the connector structures 4, 5 and the connection wire 6.

In FIG. 12, the connector structure 4 has a cover 44 capable of being opened from two directions. The cover 44 has a first side 441 and a second side 442. Two terminals of the connection wire 6 are connected with the connector structure 4 and the connector structure 5, respectively. When the connection wire 6 cannot be inserted in parallel from the first side 441 of the connector structure 4 due to the limitation of the circuit space, or when the wire needs to be specially arranged, the user is to insert the connection wire 6 from another direction. The user lifts the second side 442 of the connector structure 4 and then rotates the connection wire 6 to insert the connection wire 6 into the connector structure 4 as shown in FIG. 13. Thereby, the connector structure 4 does not need to rotate, and the wiring on the circuit board 40 does not need to be changed. It is easy to insert the connection wire 6 from the other side for completing the electrical connection.

Compared with the prior art, in the embodiment of the invention, a connector structure capable of assembling a flat flexible cable or a flexible printed circuit from two directions is formed by a single cover capable of being opened from two directions or a group of the first cover and the second cover capable of being opened from opposite directions.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A connector structure comprising:

a base, a plurality of metal pins being disposed at the base; and a cover having a first side and a second side, the first side and the second side being separately and pivotally connected to the base for covering at least one part of the metal pins;

wherein the first side of the cover is capable of being operated to be separated from the base and to rotate around the second side for exposing at least one part of the metal pins, and the second side of the cover is capable of being operated to be separated from the base and to rotate around the first side for exposing at least one part of the metal pins.

2. The connector structure according to claim 1, wherein the base has a first base and a second base, and the first side and the second side of the cover are separately and pivotally connected between the first base and the second base.

3. The connector structure according to claim 2, wherein the first base has a first groove, the second base has a second groove, the first side comprises a first hinge and a second hinge, the first hinge is separately and pivotally connected to the first groove, and the second hinge is separately and pivotally connected to the second groove.

4. The connector structure according to claim 3, wherein the first groove has a first fastening portion for fastening the first hinge.

5. The connector structure according to claim 3, wherein the second groove has a second fastening portion for fastening the second hinge.

6. The connector structure according to claim 2, wherein the first base has a third groove, the second base has a fourth groove, the second side comprises a third hinge and a fourth hinge, the third hinge is separately and pivotally connected to the third groove, and the fourth hinge is separately and pivotally connected to the fourth groove.

7. The connector structure according to claim 6, wherein the third groove has a third fastening portion for fastening the third hinge.

8. The connector structure according to claim 6, wherein the fourth groove has a fourth fastening portion for fastening the fourth hinge.

9. The connector structure according to claim 1, wherein the first side of the cover rotates around the second side toward a first direction, the second side of the cover rotates around the first side toward a second direction, and the first direction is opposite to the second direction.

* * * * *